United States Patent [19]

Schiemann

[11] 4,135,650

[45] * Jan. 23, 1979

[54] DEVICE FOR DISCHARGE NOZZLES ON CANS

[76] Inventor: Wolfram Schiemann, Eugen-Nagele-Strasse 17, 714 Ludwigsburg, Fed. Rep. of Germany

[ * ] Notice: The portion of the term of this patent subsequent to Oct. 29, 1991, has been disclaimed.

[21] Appl. No.: 613,550

[22] Filed: Sep. 15, 1975

Related U.S. Application Data

[63] Continuation-in-part of Ser. No. 467,638, May 7, 1974, abandoned.

[51] Int. Cl.[2] ..... B65D 5/72

[52] U.S. Cl. ..... 222/572; 215/1 C; 215/31

[58] Field of Search ..... 222/566, 572, 575, 465, 222/470, 475, 479–482, 488, 212, 206, 215, 210; 150/0.5; 215/1 C, 31; 220/94 A

[56] References Cited

U.S. PATENT DOCUMENTS

| | | | |
|---|---|---|---|
| 2,326,881 | 8/1943 | Pecker | 222/566 |
| 2,895,654 | 7/1959 | Rieke | 220/94 A |
| 3,128,016 | 4/1964 | Ferri | 215/31 |
| 3,372,846 | 3/1968 | Berkus | 222/479 |
| 3,744,656 | 7/1973 | Schiemann | 215/1 C |
| 3,844,456 | 10/1974 | Schiemann | 222/573 |

FOREIGN PATENT DOCUMENTS

| | | | |
|---|---|---|---|
| 560104 | 9/1957 | Belgium | 215/1 C |
| 1507327 | 11/1967 | France | 215/1 C |
| 1580460 | 9/1969 | France | 222/215 |
| 367104 | 3/1963 | Switzerland | 215/1 C |

*Primary Examiner*—Allen N. Knowles
*Assistant Examiner*—H. Grant Skaggs

[57] ABSTRACT

A blow-molded thermoplastic can has front and side walls and a nozzle integral therewith. The nozzle leads into a quarter-moon-shaped, force-absorbing protuberance in the wall of the can directed away from the can handle, which, under force, snaps inward into the can, thereby altering the position of the geometrical longitudinal axis of the nozzle.

5 Claims, 4 Drawing Figures

DEVICE FOR DISCHARGE NOZZLES ON CANS

This is a copending continuation-in-part of my patent application Ser. No. 467,638, filed May 7, 1974 and now abandoned and bearing the same title.

This invention relates to discharge nozzles on cans and more particularly to means for absorbing harmful impact forces directed on the nozzles which would otherwise damage or destroy the usefulness of the cans.

10-, 20- and 30- liter cans are known, which are blown from thermo-plastic material. Although they are much lighter, do not corrode, do not make a clattering noise, do not have to be regenerated, etc., they are not likely to supercede the known 20-liter standard can, which is also called a service can or "jerry can". Before the authorities will allow such a can it must fullfil considerable requirements. For example, it must not be torn open when it is allowed to drop, completely full, from a height of two meters at a temperature of 25° C. onto a steel plate. The known cans can withstand such a fall if they are allowed to fall onto the almost flat surfaces or even the corners of the can. However, they are torn open only too often and the cover loses its sealability if the can is allowed to fall on its most sensitive point, namely the discharge nozzle in a full condition.

In addition, the nozzles could only hitherto be closed by a screw fastening whereas it was impossible to use the popular and known claw fastener.

The problem underlying the invention is to provide a discharge nozzle which will withstand such falls without losing the required sealability, which does not tear which can be basically designed as a claw fastener or a screw cap, but which does not lead to those special solutions which are unacceptable from the commercial view point, and which remains stackable.

The problem is solved in accordance with the invention in that the can and the discharge nozzle are made of thermoplastic material, in that the nozzle leads into a force-absorbing protuberance of crescent or quarter-moon-shape. The protuberance extends directly from a straight face on the wall of the can directed away from the handle, with the tips of the moon originating on both sides of the nozzle and the bulge of the moon extending into the vicinity of the front wall of the can. In a 20-liter can the protuberance extends approximately 1.5 to 2 cm from the straight face.

If a force causes unallowable deformation of the nozzle or the wall near the nozzle the protuberance moves and snaps inward into the can thereby altering the geometrical longitudinal axis of the nozzle, absorbing the energy and eliminating the force and thereby avoiding permanent deformation of the nozzle and the adjacent wall.

Other advantages and features of the invention are shown in the following description of preferred embodiments.

Figure 1:
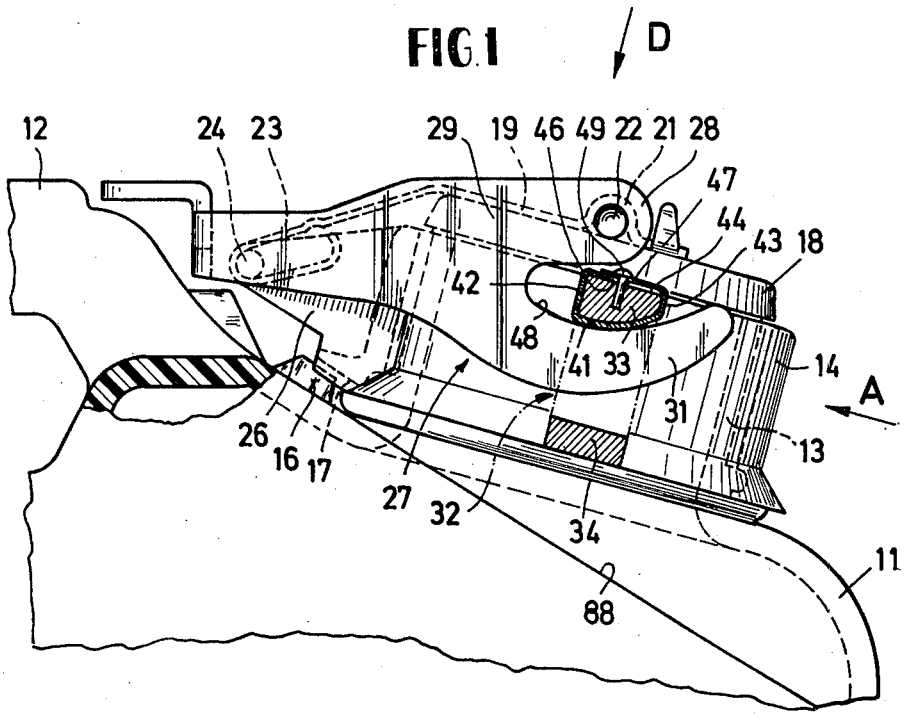
FIG. 1 shows a side view and partial section of the device according to the invention.

A can 11 made of polyethylene is provided with handles 12. A nozzle or outlet 13 made of plastics material is moulded to the wall which can be seen in FIG. 2. An outer ring 14 made of an aluminium pressure die-casting, which is rigidly connected to the nozzle 13 in an unshown manner, encloses and covers this nozzle. A cam 16 and a locking groove 17 on the outer ring 14 prevent the outer ring from rotating relative to the nozzle 13.

A fastening lid 18 is connected to tongue 19 which is provided with an arched portion 21 forming a bearing for a transverse axle 22. As shown in FIG. 1, the tongue 19 tapers to the left and leads into an extended eye 23. Located in this eye is a transverse bar 24, the ends of which are cast into triangular carriers 26, which extend parallel to and some distance from one another and are integral with the outer ring 14. Therefore the lid 18 is securely mounted on the outer ring 14.

A claw 27 of known design acts as a bearing for the transverse axle 22. It is provided with two eyes 28 which are connected to the ends of the transverse axle 22, then lead into a broad central piece 29 and are finally deflected downwards and to the right in the form of an upwardly bent finger 31. The claw 27 is made of sheet steel in accordance with the conventional method of manufacturing such claw fasteners.

Figure 2:
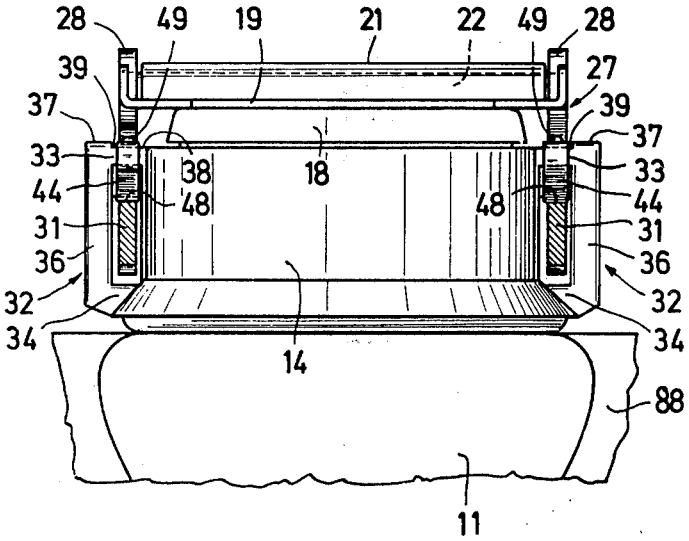
FIG. 2 shows a front view of the device according to the invention.

Moulded to the outer ring 14 are two lugs 32 which have an upper transverse web 33 and a lower transverse web 34 connected by a side 36. As can be seen in FIG. 2, the transverse web 33 is slightly lower on the side 36 so that a step 39 is formed between its upper face 37 and the upper face 38 of the transverse web 33.

The inner face 41 of the transverse web 33 is curved and extends in such a manner that the rear side 42 of the transverse web 33 is larger than the front side 43. In contrast the transverse web has a rectangular cross-section. The two ends of a spring steel strip 44 are provided with slots 46 and 47.

An insert ring 52, having an outer toothing of saw-tooth cross-section which extends co-axially to the longitudinal axis 51, is located in the nozzle 13 and also extends co-axially to its geometric longitudinal axis 51. This outer toothing 53 is associated with an inner toothing 54 on the inner side and the upper section of the nozzle 13. If the insert ring 52 which is a unitary moulding is driven into the nozzle 13, it can only be removed by considerable force, which does not occur during operation, and substantial deformation. An annular flange 56 of the insert ring 52, which extends perpendicular to the longitudinal axis 51 and the lower face 57 of which is supported on the likewise ring-shaped face 58 of the nozzle 13, acts as a stop member during insertion. A groove for receiving an O-shaped ring 59 which seals the corner section is provided for sealing purposes in the inner section of the annular face 57. To prevent the insert ring 52 from rotating, which can happen e.g. when a screw cap is used, a projection 61 which engages in a corresponding recess 62 in the nozzle 13 is provided on the ring 52 in the vicinity of the outer toothing 53. Naturally the projection could also be provided on the nozzle and the recess on the insert ring. This prevents not only the inner and outer toothing 53, 54 from being worn away by friction, but also the O-shaped ring 59 and in particular prevents the evacuating pipe 63 from rotating, the inner end 64 of which pipe is intended to point in that direction in which the known air bubble is subsequently formed when the can 11 is emptied. For this purpose the pipe which firsts extends parallel to the longitudinal axis 51 is provided with a bend 66 and then extends diagonally inwards and downwards.

On the outer side of the nozzle 13 there is provided a trapezoidal thread 65, of which the flanks 67 being approximately perpendicular to the longitudinal axis 51 act as supporting flanks. Located at the lower end of the trapezoidal threads 65, concentrically with the longitudinal axis 51, is a protuberance 68 which forms part of an annular groove 69 in which a robust O-shaped ring 71 is secured.

The inside of the outer ring 14 is also provided with a trapezoidal thread 72 which cooperates with the trapezoidal thread 65 and the flanks 73 of which are supported on the flanks 67, but have a visibly axial clearance. When mounted, the O-shaped ring 71 is compressed by a skirt 74 so that the flanks 67, 73 always bear against one another without any clearance. Any kind of pretensioning means for pressing the outer ring 14 outwards could also be used. The lower edge 76 of the skirt 74 is separated from the nearest plastic sections by several millimeters.

A member 77 for preventing rotation which, in the preferred embodiment, provides a plasticsnose 78 on the can 11 below the skirt 74 and a recess 79 in the skirt 74, is provided outside the O-shaped ring 71 and below the carriers 26. The cooperation of the trapezoidal threads 65, 72, on the one hand, and the plastics nose 78 and the recess 79, on the other hand, is such that, just when the carriers 26 are directed towards the handles 12, the outer ring 14 is screwed far enough onto the nozzle 13 and at the same time the plastics nose 78 engages in the recess 79. In this case the nose 78 is locked in the recess 79 at such a depth that it can no longer be disengaged on account of the forces occuring during operation. In this case this snap action effect is obtained by pressing the plastics nose 78, which is connected to a resilient surround, further and further into the can 11 until the recess 78 is positioned above the nose.

Figure 3:
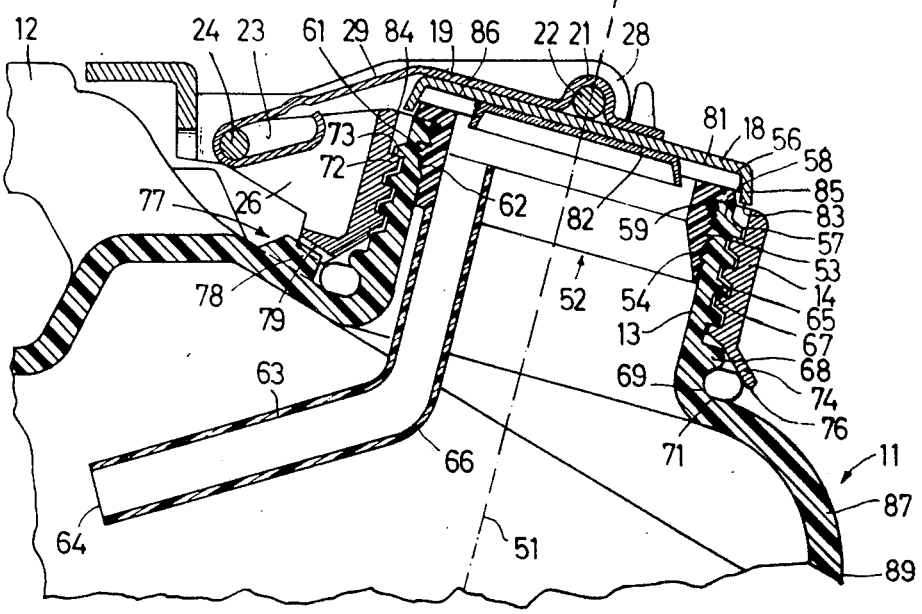
FIG. 3 shows a view similar to FIG. 1, but in cross-section through the nozzle in the longitudinal direction of the can.

The interior of the fastening lid 18 is provided with a sealing ring 81, the inner periphery of which is retained by a plate 82. The lid 18 has an edge 85 which is pulled downwards as shown in FIG. 3, the lower ring-shaped face 83 of said edge being clearly separated from the upper face 84 of the outer ring 14. The upper face 58 of the nozzle 13 is likewise not in contact with the edge 85 and the same applied also to the upper face 86 of the insert ring 52.

Figure 4:
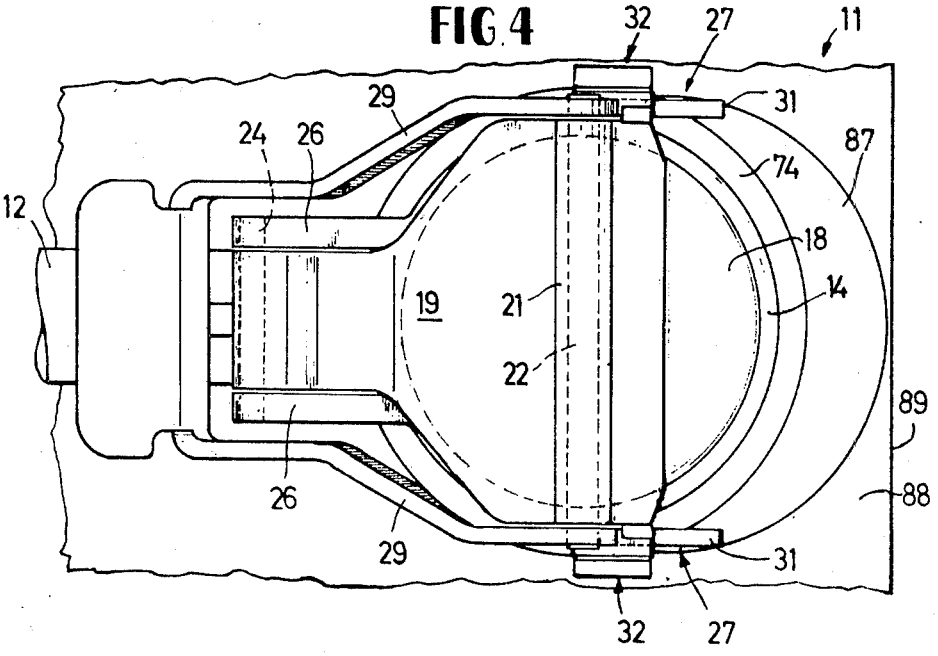
FIG. 4 shows a plan view in the direction of the arrow D in FIG. 1.

A safety device in the event of a fall consists of providing a protuberance 87 which has a quarter moon shape as shown in FIG. 4, the points of the moon-shaped protuberance beginning below the lugs 32. The bulge of the protuberance extends almost as far as the front wall 89 of the can. If the can falls on the fastener, the protuberance 87 snaps inwards thereby eliminating the force. This quick action device could also take different forms. It does not necessarily have to be in the form of a quarter moon, although the energy consuming action of such an arrangement has the advantage that the can may be more easily emptied because the protuberance provides more favourable flow conditions and also acts as a reservoir for the remaining fluid if the can is in an inverted position so that residue-free emptying of the can can be more easily achieved than before.

A side view of the straight face 88 can be seen in FIG. 1. The protuberance 87 passes smoothly into the surrounding face 88.

The invention may also be used for discharge nozzles which have a screw cap in place of a claw fastener 18. In this event, instead of the outer ring 14 there is provided an outer ring which has an outer thread.

The protuberance 87 has at its bulge or apex area an angular vertical length of at least 50 degrees, as seen in FIG. 3 in the cross hatched area at the lower right. Preferably, the arc length is between 70 to 90 degrees. It is not an exactly circular arc. It has been observed that if the arc is too short, e.g. less than 50 degrees, the relation of the stiffness of the material of the wall of the protuberance to the length of the arc is such that no appreciable snap-in movement of the protuberance 87 is possible upon impact. The arc's angle goes to zero at the moon's points.

What is claimed is:

1. A blow-molded thermoplastic can having front and side walls, a straight face portion, a nozzle blow-molded integral therewith, handle means, and cover means for closing off said nozzle, said nozzle being rooted in energy consuming means in the wall of said can, blow-molded integral therewith, said energy consuming means having the form of a protuberance, extending from said straight face portion of the can, said protuberance leading directly from and being surrounded by said straight face portion and comprising a main bulging portion having an arc length of at least 50 degrees extending outwards from said straight face portion on the side of said nozzle directed away from said handle means, said nozzle being rooted below said handle means and said main bulging portion of said protuberance extending upwards and spacing said nozzle from said straight face portion from which said protuberance extends and being of such thickness and operably associated with said nozzle to snap substantially inwards into said straight face portion upon impact forces of substantial strength on said nozzle, substantially altering the longitudinal axis of said nozzle, and to move substantially outwards from said straight face portion to return the longitudinal axis of said nozzle to said unaltered position.

2. A blow-molded thermoplastic can according to claim 1 in which said main bulging portion of said protuberance extends from said straight face portion of said can with an arc length of approximately 70 to 90 degrees.

3. A blow-molded thermoplastic can according to claim 1 in which said main bulging portion of said protuberance extends from said straight face portion of said can in a non-circular arc.

4. A blow-molded thermoplastic can according to claim 1 in which in plan view the protuberance is shaped approximately like a quarter-moon, the tips of the moon originating on both sides of said nozzle and said main bulging portion of the moon extending into the vicinity of a side wall of the can.

5. A blow-molded thermoplastic can according to claim 1 in which in the case of 20-liter cans, the protuberance extends from the straight face approximately 1.5 to 2 cm.

* * * * *